US005388315A

United States Patent [19]

Jones

[11] Patent Number: 5,388,315

[45] Date of Patent: Feb. 14, 1995

[54] LACING SYSTEM

[76] Inventor: Nathan B. Jones, 914 Flat Hill Rd., Lunenberg, Mass. 01462

[21] Appl. No.: 51,172

[22] Filed: Apr. 22, 1993

[51] Int. Cl.[6] ..... A43B 11/00; A43C 7/00

[52] U.S. Cl. ..... 24/712.1; 24/713.1; 36/50.1

[58] Field of Search ..... 24/713.1, 713.6, 714.6, 24/715.1, 715.4, 715.6, 712.1; 36/50.1

[56] References Cited

U.S. PATENT DOCUMENTS

| | | | |
|---|---|---|---|
| 544,349 | 8/1895 | Burgin . | |
| 911,573 | 2/1909 | Crooks . | |
| 1,685,489 | 9/1928 | Jansen . | |
| 2,009,330 | 7/1935 | Tate | 24/713.1 |
| 2,451,124 | 10/1948 | Sims | 24/713.1 |
| 3,254,443 | 6/1966 | Olson . | |
| 3,701,572 | 10/1972 | Velasquez . | |
| 3,725,976 | 4/1973 | MacKeown . | |
| 4,251,070 | 2/1981 | Leseberg | 36/50.1 X |
| 4,317,337 | 3/1982 | Walden et al. . | |
| 4,631,840 | 12/1986 | Gamm | 36/50.1 X |
| 5,023,982 | 6/1991 | Mehan . | |
| 5,293,675 | 3/1994 | Shai | 24/712.1 |

FOREIGN PATENT DOCUMENTS

| | | |
|---|---|---|
| 175507 | 8/1905 | Germany . |
| 456539 | 11/1936 | United Kingdom . |

*Primary Examiner*—John T. Kwon
*Assistant Examiner*—Hoang Nguyen
*Attorney, Agent, or Firm*—David Fink

[57] ABSTRACT

The invention relates to a lacing system suitable for lacing a shoe having eyelets, comprising a stretchable lace adapted for being laced in the eyelets; and lace locking device connected to one end of the lace and comprising an elongated body operable for engaging the other one end of the lace so that the lace ends are substantially collinear with each other and the other lace end is releasably retained in the body through friction with the body when the shoe is engaged with a foot or disengaged from a foot.

1 Claim, 3 Drawing Sheets

LACING SYSTEM

TECHNICAL FIELD

The present invention relates to a shoelace and the like, and more particularly to a lacing system for shoes, sneakers, boots and the like.

BACKGROUND OF THE INVENTION

Stretchable shoelaces are known in the prior art. A recent patent thereon issued to Mehan, U.S. Pat. No. 5,023,982 which discloses a shoelace made of elastic strands woven into a tubular configuration with plastic tips thereon so that it can be tied. Laces similar to bungee cords are also known. Some of the advantages of stretchable shoelaces have been appreciated in the prior art for use in athletic shoes; however, the arrangements are aesthetically unattractive.

SUMMARY OF THE INVENTION

It is an object of this invention to provide a lace system enabling a shoe, sneaker, boot or the like to be engaged by a foot and disengaged by the foot without requiring the laces to be tied and untied for each event.

It is a further object of this invention to provide a lace system for a shoe, sneaker, boot or the like suitable for use by individuals having a physical disability, such as arthritis, which makes tieing laces difficult by eliminating the necessity of tieing and untieing the laces for each time the shoe is engaged or disengaged.

Another object of the invention is a lace system for use with a shoe having a tongue so that the tongue of the shoe can be moved forward, thereby stretching the laces for insertion or removal of one's foot in or out of the shoe.

Another object of the invention is to eliminate the need to knot or double-tie traditional shoelaces to prevent their becoming untied during normal wear.

It is a still further object of this invention to provide a lace system to replace shoelaces and designed to be safer to use than prior art laces since the lace according to the invention will not become untied and dangle and pose a danger to its user.

It is an additional object of the invention in one embodiment to have a structure of the stretchable lace unique when compared to laces of the prior art because the present lace is preferably composed of non-woven, solid-sided, tubular, or of completely solid, construction made of a plastic or rubber-like stretchable material which immediately returns to its unstretched state of which there are a variety of types available.

In a broad embodiment, the invention relates to a lacing system suitable for lacing a shoe having eyelets, comprising a stretchable lace adapted for being laced in the eyelets; and lace locking means connected to one end of the lace and comprising an elongated body operable for engaging the other one end of the lace so that the lace ends are substantially collinear with each other and the other lace end is releasably retained in the body through friction with the body when the shoe is engaged with a foot or disengaged from a foot.

In another embodiment, both ends of the lace are releasably retained through friction to the elongated body.

In a specific embodiment, the ends of the lace are hollow cylinders and the lace closing means is shaped to be pressed into each hollow cylinder.

In another specific embodiment, the lace closing means has openings on opposite ends shaped to receive the respective lace ends and the ends of the lace are pressed into the respective openings for the frictional engagement.

Other objects, features and advantages of the invention will become apparent upon reading the specification.

BRIEF DESCRIPTION OF THE DRAWING

For a fuller understanding of the nature and objects of the invention, reference should be had to the following detailed description, taken in connection with the accompanying drawings in which.

DESCRIPTION OF THE PREFERRED EMBODIMENT(S)

The invention is shown in the FIGS. 1–4. Basically, the invention provides a simple system for "tieing" shoelaces without the problems associated with prior art laces. One of the elements of the invention is a stretchable lace. Stretchable laces are known and are commercially available in many different forms.

Typically, stretchable laces are in the form of woven strands. It has been found that for the practice of the invention, it is preferable to use stretchable tubing made from a stretchable, rubber-like materials such as a resin or plastic including, but not limited to, elastomers, teflon, silicon, latex, urethanes, vinyls, PVCs and the like. Some of these materials are available in a variety of fluorescent colors or even phosphorescent glow-in-the-dark dark colors and this can be advantageously used for marketing the invention.

Typically, the tubing can be provided with an outer diameter size of from $\frac{1}{8}$ to about 3/16 inch, suitable in size to pass through the shoe eyelets of most shoes, boots and sneakers. Some shoes have relatively large eyelets and can use a shoelace according to the invention having a diameter of from about $\frac{1}{4}$ inch outer diameter down to about 1/32 inch outer diameter.

The cross section of the lace can also be varied and made attractive. The cross section of the end of the lace engaging the locking means should be compatible. Hence, a cylindrical cross section can provide a wide range of shapes and, if desired, can include a tapered end.

As used herein, the terms "lace" "shoelace" and "shoelaces" refer in each case to laces in general for shoes, sneakers, boots and other foot wear or the like as well as any other object having eyelets and capable of accepting a lace or laces for being secured.

The lace of this invention has sufficient stretchability and retention memory to return substantially immediately to substantially its original unstretched state.

Figure 1:
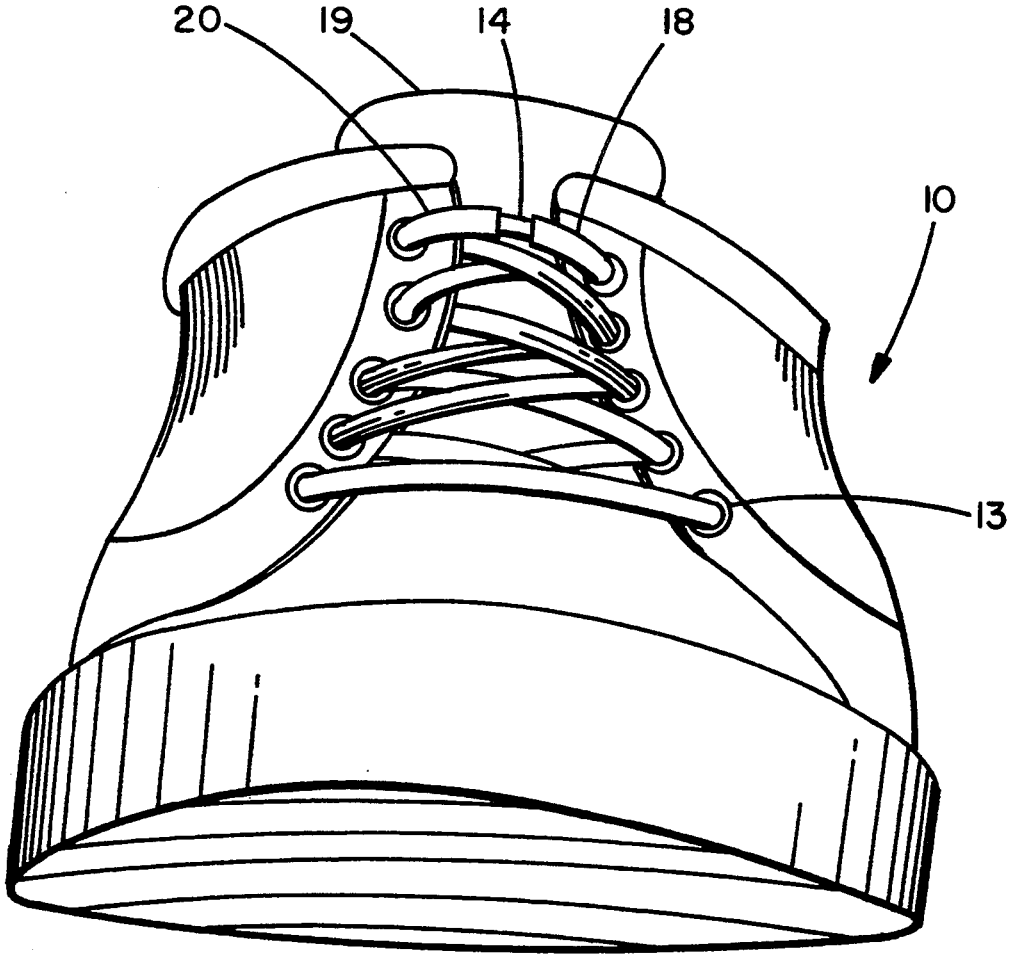
FIG. 1 illustrates a front elevational view of a shoe showing one embodiment of the lacing system according to the invention.
Figure 2:
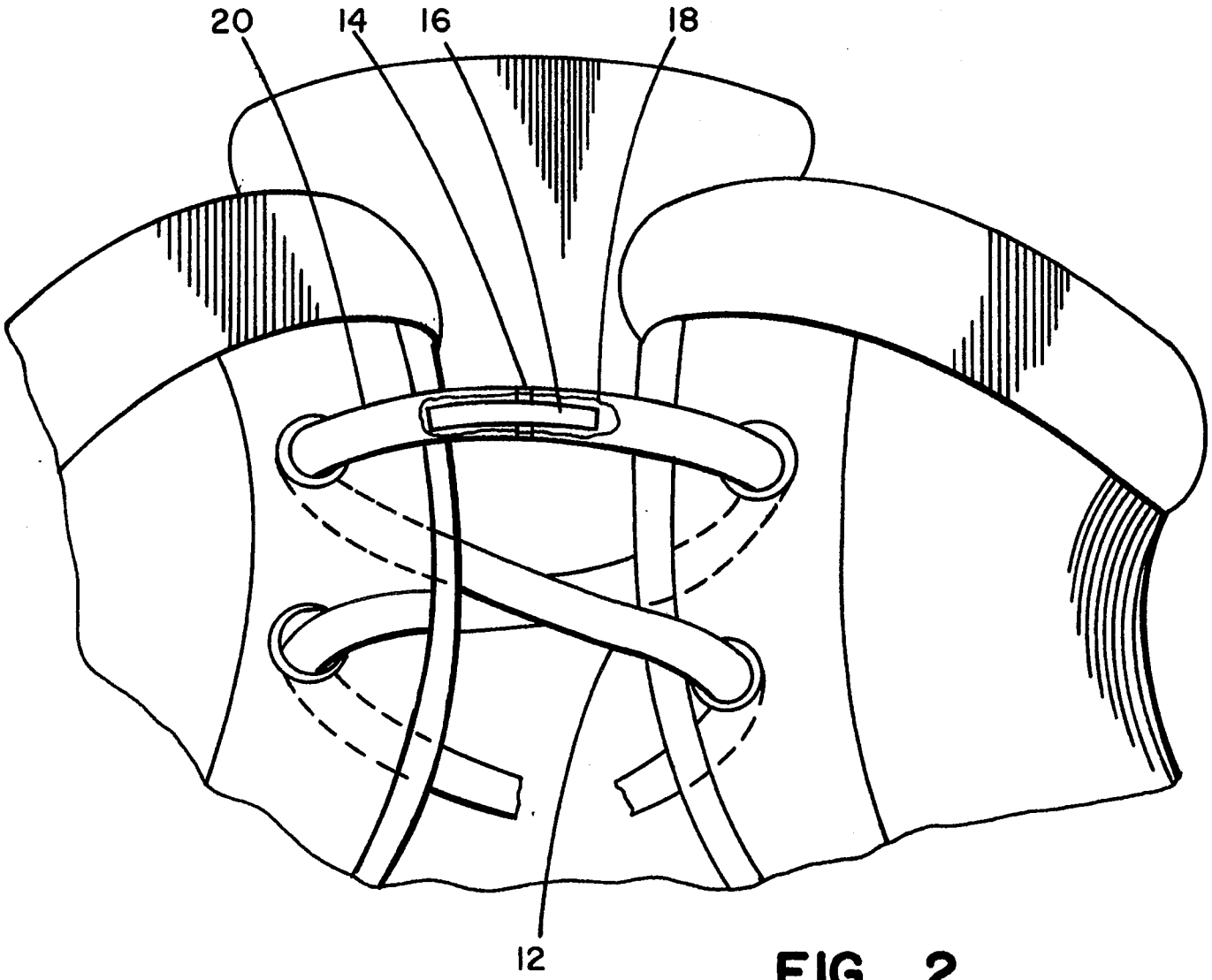
FIG. 2 shows an enlarged view of the upper front portion of the shoe of FIG. 1 with a portion of the lace removed to show the interior detail.

FIG. 1 shows a typical shoe 10. Lace 12 is laced through eyelets 13. When lace 12 is laced into the shoe 10, the two ends of the lace 18 and 20 come together at a junction 14 which is seen in the enlarged view of FIG. 2. Each end 18 and 20 has a hole defined therein extending longitudinally. Lace closing means such as closure 16 is inserted into respective holes of ends 18 and 20. By inserting ends 18 and 20 over closure 16 until ends 18 and 20 substantially abut one another, the ends of the lace form what appears to the eye to be a smooth continuous lace surface, thereby providing an improved visual appearance. This is particularly attractive to footwear in contrast to the often unsightly appearance of shoes with traditional laces.

The closure 16 can be substantially permanently affixed to one end of the lace. The closure 16 can be formed as an integral part of one of the ends of the lace 12. The closure 16 can have printing thereon, such as a company logo, or other decoration.

The lace of this invention can be available in many lengths based on the number of eyelets of the shoe to be laced. Adjustments in length can be made simply by cutting off one or both ends of the shoelace until the desired length is achieved for a smooth continuous lace surface.

Preferable a shoe tongue 19 is present to contribute to the smooth movement of the laces 12 as it expands and contracts in response to the shoe 10 being removed or put on by the user.

Figure 3:
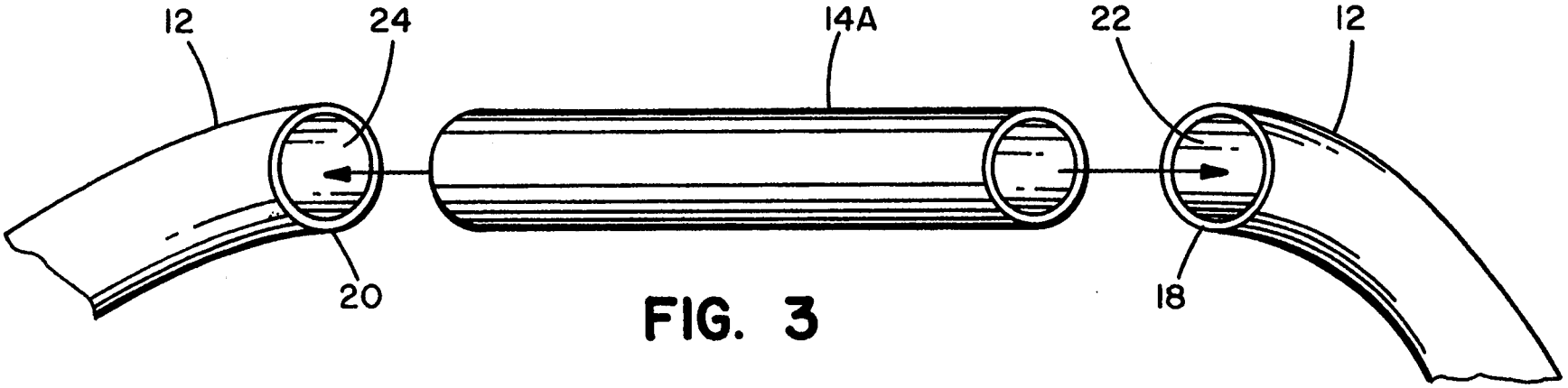
FIG. 3 shows a detail of one embodiment of a lace locking means for the lace system according to the invention.

FIG. 3 illustrates a preferred embodiment of the closure 14*a* which can be solid and can have a length no longer than the distance between the top two eyelets of the shoe on which the lace will be used. Closure 14*a* engages first and second openings 22 and 24 of first and second ends 18 and 20, respectively, of lace 12. The closure 14*a* can be cylindrical as shown but can be of other shapes as well, such as flat members, as long as it engages snugly in openings 22 and 24. When the closure 14*a* is inserted into ends 18 and 20, there is sufficient friction between plug 14 and the insides of respective ends 18 and 20 to retain the ends 18 and 20 in closure 14*a* during the expected tension arising from walking, removing and putting on the shoe 10. If however, it is desirable to remove one or both ends 18 and 20, then ends 18 and 20 are pulled with sufficient force by hand therefrom to remove one or both from closure 14*a* to allow for the removal of the lace 12.

It has been found that one does not frequently have to undo laces according to the invention as they stretch without separating form the lace closing means thereby allowing the foot to be inserted or removed from the shoe while leaving the lace unchanged.

Figure 4:
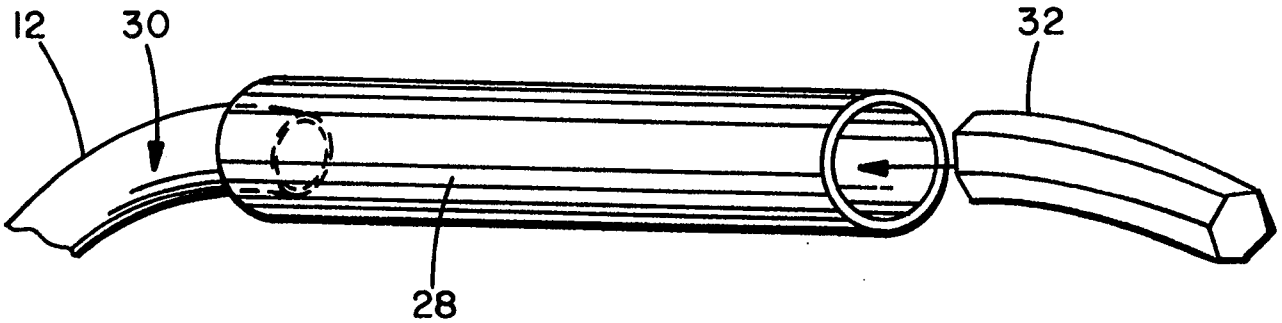
FIG. 4 shows a detail of another embodiment of a lace locking means for the lace system according to the invention.

Closure 28 is another embodiment as shown in FIG. 4. The closure 28 has the form of a tubular member having longitudinal openings at the respective ends. Preferably, the tubular member is a hollow tubular cylinder which can engage the outside diameter of the lace ends 30 and 32. If the inside diameter of the closure 28 is large enough to fit over the outside diameter of each end of shoelace 12 as seen in FIG. 4 and provide sufficient friction, then the closure 28 can function as a lace closing means.

In its preferred embodiment, lace closing means engages the inside the lace ends so as to from a smooth junction between the lace ends. Lace closing means can be made of rubber, plastic or other equivalent rigid or semi-rigid material having a relatively high coefficient of friction with the lace according to the invention. To further increase friction between the lace and the lace closing means, the lace closing means can have ridges on its outer surface or equivalent means to increase friction between the lace and the lace closing means. Techniques for achieving good friction and retaining forces for the practice of the invention are well known in the prior art.

The tubular configuration of the lace of according to the invention can be an extruded tubing or otherwise formed and even can be constructed in non-cylindrical outer shapes such as triangular, hexagonal, oval or square cross-sectional shapes such as shape 32 in FIG. 4 as long as the lace is stretchable and the shapes of the hollow portion within the tubing and the shape of the lace closing means are compatible and engage each other according to the invention.

In an alternate embodiment where the shoelace is formed of a solid, elongated, non-hollow cylindrical piece such as end 30 of the stretchable material. The corresponding lace closing means preferably should be an externally fitting sleeve as described above which fits over the solid ends of such shoelace. The closure sleeve which fits over such solid lace of this invention can be decorative.

The lace in one of the preferred embodiments for use in popular athletic shoes can be made of tubing in bright fluorescent colors, but the tubing does not necessarily have to be of a single color. It can, for example, be multicolored with stripes, such as candy cane design, or can be co-extruded in many colors, have metallic flakes or have grooves with a different color on the sides of the grooves.

It is believed that the tubular material of the lace of this invention provides a significant improved appearance over the woven, stranded material of prior art laces which will collapse into a flattened shape as they are laced through the eyelets of a shoe and pulled tight. The lace of this invention when laced through shoe eyelets has been found to retain much of its circular cross-sectional configuration which gives the shoe a very neat appearance and is an advance in footwear technology.

Although the present invention has been described with reference to particular embodiments, it will be apparent to those skilled in the art that variations and modification can be substituted therefor without departing from the principles and spirit of the invention.

What is claimed is:

1. A lacing system suitable for lacing a shoe having eyelets, comprising a stretchable lace having first and second ends and being adapted for being laced in the eyelets; said first and second lace ends each having an opening defined therein; and lace locking means comprising an elongated body operable for engaging the opening in each of said first and second lace ends so that said first and second lace ends are substantially collinear with each other and said first and second lace ends are releasably retained in said body through friction with said body when the shoe is engaged with a foot or disengaged from a foot.

* * * * *